US006923292B2

(12) United States Patent
Woods et al.

(10) Patent No.: US 6,923,292 B2
(45) Date of Patent: Aug. 2, 2005

(54) ATTACHMENT FOR RECOIL, NOISE, BLAST AND FLASH SUPPRESSION OF THERMODYNAMIC JETTING DEVICES SUCH AS FIREARMS, HIGH PRESSURE EXHAUST MECHANISMS AND OTHER HEAT ENGINE DEVICES, WHICH PRODUCE SUCH JETTING EXHAUST ACTION AS A RESULT OF THEIR FUNCTION

(76) Inventors: Robert James Woods, 3043 E. Clarendon Ave., Phoenix, AZ (US) 85016-7014; JeanMarie Evangeline Serrano, 1388 Mustang Dr., Danville, CA (US) 94526-5150

( * ) Notice: Subject to any disclaimer, the term of this patent is extended or adjusted under 35 U.S.C. 154(b) by 0 days.

(21) Appl. No.: 10/413,685

(22) Filed: Apr. 15, 2003

(65) Prior Publication Data

US 2004/0079221 A1 Apr. 29, 2004

Related U.S. Application Data

(60) Provisional application No. 60/420,447, filed on Oct. 24, 2002.

(51) Int. Cl.[7] ..... F41A 21/00

(52) U.S. Cl. ..... 181/223; 89/14.4

(58) Field of Search ..... 89/14.4; 42/79; 181/223; 244/1 N; 239/265.11

(56) References Cited

U.S. PATENT DOCUMENTS

| | | | | | |
|---|---|---|---|---|---|
| 2,101,850 | A | * | 12/1937 | Green | 181/223 |
| 2,351,037 | A | * | 6/1944 | Green | 89/14.4 |
| 2,503,491 | A | * | 4/1950 | Janz | 181/223 |
| 4,024,790 | A | * | 5/1977 | Heiderer | 89/14.4 |
| 4,939,977 | A | * | 7/1990 | Stroup | 89/14.4 |
| 6,385,891 | B1 | * | 5/2002 | Rabatin | 42/79 |

* cited by examiner

*Primary Examiner*—Harry B. Tanner
(74) *Attorney, Agent, or Firm*—Michael A. Shippey; Law Offices of Karla Shippey

(57) ABSTRACT

Our invention describes a muzzle or exit exhaust attachment for firearms or other thermodynamic heat engine jetting devices and incorporates magnetic field diversion design features not previously utilized to increase efficiency in the reduction of noise, flash, barrel whip, exhaust flame temperature and muzzle blast effect. Our invention advantageously applies relatively recent discoveries in the field of ballistic studies; know as transition ballistics, and mitigates the high velocity, high pressure exhaust gasses from the instant of existence through decline to atmospheric pressure with greater efficiency than prior art devices such as, silencers, suppressors, mufflers and sound absorber attachments.

20 Claims, 3 Drawing Sheets

30
40
45
50

20
22
25

5
10
6
7

6
18
(Narrow layers)
16
(Wider layers)

ATTACHMENT FOR RECOIL, NOISE, BLAST AND FLASH SUPPRESSION OF THERMODYNAMIC JETTING DEVICES SUCH AS FIREARMS, HIGH PRESSURE EXHAUST MECHANISMS AND OTHER HEAT ENGINE DEVICES, WHICH PRODUCE SUCH JETTING EXHAUST ACTION AS A RESULT OF THEIR FUNCTION

CROSS REFERENCE TO RELATED APPLICATIONS

This aplication claims benefit of U.S. Provisional No. 60/420,227 filed Oct. 24, 2002.

STATEMENT REGARDING FEDERALLY SPONSORED RESEARCH OR DEVELOPMENT

Not applicable

REFERENCE TO SEQUENCE LISTING, A TABLE OR A COMPUTER PROGRAM LISTING COMPACT DISK APPENDIX

Not applicable

BACKGROUND OF THE INVENTION

This invention describes a muzzle or exit exhaust attachment for firearms or other thermodynamic jetting devices and incorporates design features not previously utilized to increase efficiency in the reduction of noise, flash, barrel whip, exhaust flame temperature and muzzle blast effect. This invention takes advantage of relatively recent discoveries in the field of ballistic studies, known as transition ballistics, which utilize the high velocity motion of high pressure gasses from the very earliest moment of existence through the final instant of pressure decline to atmospheric pressure in an improved design that provides greater efficiency of function than prior art devices such as, silencers, suppressors, mufflers and sound absorber attachments.

This invention is comprised of three coaxial tubular chambers assembled as a primary chaotic divergent expansion chamber, a secondary convergent compression chamber and a magnetic diversion chamber. The first two chambers provide a preconditioning effect, by firstly enhancing expansion and cooling of the high velocity gas exhaust column that increases the gas velocity and reduces its pressure and secondly, by further directing the exhaust gas column into the secondary convergent compression chamber in which the gas column is compressed thereby reducing its exit nozzle velocity as either less than or equal to, but never greater than the velocity of sound regardless of the magnitude of the pressure within the secondary compression chamber.

The preconditioned high pressure gas column now exits the compression chamber nozzle and is immediately acted upon by the third and final stage of this invention, the magnetic diversion chamber. This chamber comprises a metallic tube which houses, retains and provides coaxial alignment for an assembly of high magnetic intensity rare earth magnetic toroids that, in turn are separated, retained and compressed by wave washers between each magnetic toroid thereby providing an aligned assembly retained in position by the threaded retaining ring baffle plate which provides a rigid final exit passage of a projectile or gaseous column.

The object of the coaxial assembly of rare earth magnetic toroids is to utilize the force known as Lorenz effect that directs a force perpendicular to the high velocity gaseous particle flow, thereby redirecting, helically confining and delaying, cooling and extracting energy from the gaseous exhaust column. This action provides superior efficiency in recoil reduction, flash and blast suppression than so far attained in prior art suppression devices.

Information in support of the concept, design and development of this invention has been obtained by reference to prior art patents, publications from national laboratories, symposium proceedings, the publications of the various armed forces of the United States, college and university published research and research by manufacturers prominent in the field of ballistic science.

Publications Referenced

Weapon Systems Fundamentals, NAVWEPS OP 3000, volume 2, published by U.S. Navy Bureau of Naval Weapons.

The Machine Gun, Volumes 1 through 5, by George Chinn, U.S. Marine Corp., for the U.S. Navy Bureau of Ordnance.

Counter Sniper Technology, Proceedings of the 5$^{th}$ Battlefield Acoustics Symposium, Ft. Mead, Md., September 1997

General Atomics Corp., Plasma Physics Group, San Diego, Calif., 2001, Magnetic Confinement of Charged Particles Schrodinger's Machines, Gerard J. Milburn, published by W. H. Freeman Company, New York, N.Y. ISBN 0716731061

University and Laboratory Published Research Lawrence Laboratory, University of CA, Berkeley, Calif.

Center For Innovative Sintered Products, P/M Laboratory, Penn State University, PA Ames National Laboratory, Rare Earth Information Center NIST, Boulder Magnetic Research Group, Boulder, Colo.

National High Magnetic Field Laboratory, Florida State University, Tallahassee, Fla.

US Patent Office, Prior Art Patents Searched

U.S. Pat. No. 1,482,805, Maxim, Feb. 5, 1924
U.S. Pat. No. 1,525,846, Wurtzebach, Feb. 10, 1925
U.S. Pat. No. 1,636,357, Cutts, Jul. 19, 1927
U.S. Pat. No. 2,101,063, Green, Dec. 7, 1937
U.S. Pat. No. 2,101,848, Green, Dec. 14, 1937
U.S. Pat. No. 2,101,848, Green, Dec. 14, 1937
U.S. Pat. No. 2,128,936, Green, Sep. 6, 1938
U.S. Pat. No. 2,150,161, Green, Mar. 14, 1939
U.S. Pat. No. 2,184,595, Green, Dec. 26, 1939
U.S. Pat. No. 2,339,777, Green, Jan. 25, 1944
U.S. Pat. No. 2,351,037, Green, Jun. 13, 1944
U.S. Pat. No. 2,375,617, Bourne, May 8, 1945 assign/Maxim Silencer Corp.
U.S. Pat. No. 2,404,632, Ivanovic, Jun. 25, 1946
U.S. Pat. No. 2,625,235, Caulkins, Jan. 13, 1953
U.S. Pat. No. 3,152,510, Ashbrook, May 1, 1962
U.S. Pat. No. 3,455,203, Pillersdorf, Jul. 15, 1969
U.S. Pat. No. 3,492,912, Ashbrook, Feb. 3, 1970

Foreign Patents Researched

#233,709, Great Britain, January, 1926
#633,617, Belgium, October, 1963
#512,773, Italy, February, 1955
#623,779, Italy, August, 1961

DETAILED DESCRIPTION OF THE INVENTION

This description of our invention is provided to enable any person skilled in the art to make and use the invention and sets forth the best modes contemplated by the inventors of carrying out our invention.

Our invention defines a muzzle attachment for firearms or other thermodynamic jetting devices with design features not previously utilized which increase efficiency in the mitigation and control of recoil, noise, flash, barrel whip and blast effect. Our invention takes advantage of relatively recent discoveries in the field of ballistics studies, known as transition ballistics, that describes the high velocity motion of high pressure propellant gasses from their very first moment of existence through their final instant of pressure decline to atmospheric pressure. Our invention conditions, controls, modifies and mitigates the high velocity, high pressure gaseous column in a manner that results in greater efficiency of function than prior art devices such as silencers, suppressors, mufflers and sound absorbers have provided.

Figures 5A, 5B, 5C:
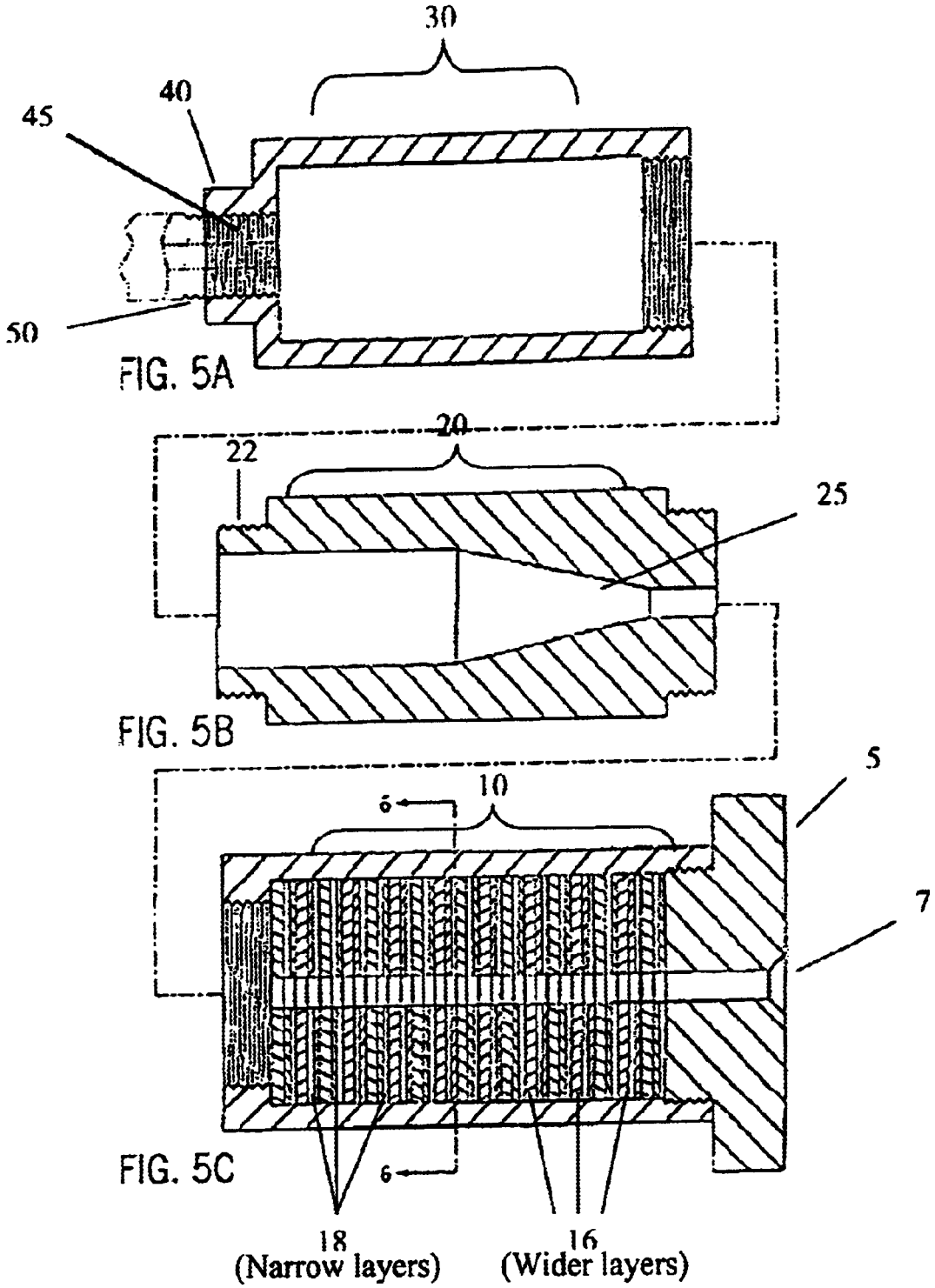
FIG. 5A displays the sectionalized view of the primary chaotic diversion chamber in a typical configuration of attachment by threaded coupling to the muzzle of a barrel or other exhaust system outlet.
FIG. 5B displays the sectionalized view of the secondary convergent diversion chamber with it's threaded mating surfaces. The converging portion of the chamber is critical to the pre-conditioning of the high pressure gas to reduce gas velocity, cool the gas temperature and dissipate gas column energy.
FIG. 5C displays a sectionalized view of the magnetic diversion chamber comprising concentric and coaxially stacked high intensity rare earth magnetic toroids, separated by wave washers that are compressed and retained by the threaded boss muzzle flange.

The preferred embodiment of our invention is the magnetic diversion chamber fully illustrated in FIG. 5C. The magnetic diversion chamber utilizes as part of its assembly, high magnetic field intensity rings or toroids, commonly referred to as rare earth magnets or super magnets. These magnetic rings, made of various combinations of powdered iron, samarium, neodymium, cobalt, boron, carbon and other exotic elements, are inherently capable of producing and maintaining permanent high intensity magnetic fields virtually totally contained within the confines of their torus shape and the central hole within the torus shape. Magnetic field intensities of 10,000 gauss to 30,000 gauss, 1 tesla to 3 tesla, are readily available in various sizes of these magnetic toroids.

The high intensity magnetic force produced by these toroids encompasses and maintains, in addition to an intense magnetic field, a collateral force known as the Lorenz effect, on elemental particles of matter. Unlike the gaseous column pressure, which exerts itself in no preferred direction, Lorenz force is a force that is exerted on a flow of charged particles, such as high velocity gasses, in such a manner as to produce a force perpendicular to the particle flow of the gasses moving through the centralized hole of the torus. The Lorenz perpendicular force strongly influences the gaseous column charged particles, thereby introducing a change of direction by exerting helically delayed particle flow mitigated by the interconnecting magnetic field lines within the centralized toroid hole. The action of the helically diverted particles enhances inertial confinement and cooling of the particle mass thereby extracting energy from the high velocity gas flow that reduces its velocity, direction and energy to a greater degree than available prior art devices have been able to attain in practice.

In addition to the useful perpendicular diversion and helical containment Lorenz force exerts on charged particle flow, it also enhances the disruption of the Coanda effect that describes the tendency of any gas flow to cling or entrain to the wall of the surface it is flowing past. The Lorenz force, by disrupting the clinging and entraining effect of the Coanda force, extracts additional energy from the gaseous particle flow that adds to the overall efficiency of our invention in the suppression of noise, blast, recoil, flash and barrel whip that exceeds the efficiency of prior art suppressors, silencers, mufflers and sound absorbers.

Virtually since the inception of firearms, the processes utilized to analyze, evaluate, test and classify firearms performance was addressed solely by the parameters of interior and exterior ballistics. That is, the interior events prior to exit of the projectile from the barrel bore and exterior events affecting projectile and high velocity, high pressure propellant gas behavior after exit from the barrel bore until final projectile impact. Relatively recent developments in high speed photography know as Schlieren photography have allowed the clarification of the critical transition area of ballistics providing visual proof of events that occur in all firearms from the instant of propellant ignition and events occurring thereafter. One of the claims of our invention is to advantageously address all events of ballistic study, including transition ballistics, in developing a muzzle attachment that exceeds prior art devices in efficiency of overall function of controlling and mitigating recoil, noise, flash, blast and barrel whip.

In order to support our claims in this invention, it is necessary to define and illustrate the events that comprise the previously stated interior, transition and exterior ballistics and the manner in which our invention utilizes these events to mitigate recoil, noise, flash, blast and barrel whip.

Figure 1:
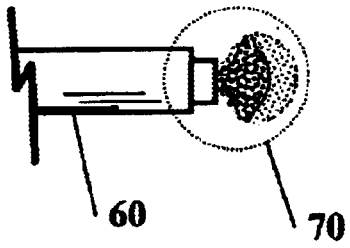
FIG. 1 displays a Schlieren high speed photograph of the atmospheric contents of the barrel bore, exiting approximately 2 to 3 milliseconds after propellant ignition and directly ahead of the following projectile.

The first event is that column of forward atmospheric air, illustrated in FIG. 1, which occupies the entire length of the barrel bore immediately ahead of the projectile of the chambered cartridge prior to propellant ignition. Upon propellant ignition, the projectile moves forward, compressing and accelerating the forward air mass toward the muzzle, causing the forward air mass to emerge from the muzzle first. The forward air mass, now traveling at high velocity, strikes the atmospheric air which is at rest at the muzzle, creating a shock wave known as the report wave 70, that develops spherically and greatly disturbs the atmospheric air at the muzzle. This event is instantly followed by a rush of small amounts of propellant gas 72, FIG. 2, which have forced their way past the projectile body and therefore emerge from the muzzle before the projectile. This condition is proven to exist in all firearms, regardless of caliber or bore or great care in sizing the projectile to the bore. As the projectile clears the muzzle of the barrel, FIG. 3, the main mass of propellant gasses 74 are violently ejected into the already disturbed outside atmosphere. At this instant, the velocity of the propellant gas is equal to the projectile velocity; but due to the great residual gas pressure, and small mass and momentum of the propellant gas, its velocity instantly increases, causing the main propellant gas column to overtake the projectile; rapidly passing it. This time period is the cause of what is known as secondary muzzle flash and is present in all propellant actuated firearms, caused by the now depleted source of oxygen in the propellant mixture not being sufficient to consume all of the propellant and its residual hydrogen. These residual unburned particles and hydrogen gas instantly receive a substantial source of fresh oxygen from the atmospheric air that instantly detonates the unburned fuel thereby enhancing the muzzle blast effect. During this brief but critical phase of the total event, the propellant gasses achieve a maximum velocity of more than twice that of the projectile and consequently imparts to the projectile additional thrust pressure, causing the projectile to reach maximum velocity, not at the muzzle, but a short distance ahead of the muzzle.

The propellant gasses lose velocity very rapidly, due to their low mass and air resistance it meets which retards continued motion. High speed photography shows the projectile overtakes the main propellant gasses 74 very close to 35 centimeters, about 14 inches, in front of the muzzle in virtually all firearms up to light cannon caliber. Shortly after this occurrence, the projectile overtakes and pierces the well developed report wave, the source of the familiar noise commonly associated with gunfire. Concurrent with this event, the projectile is accompanied by its normal head wave that is defined as the projectile shock wave.

It is important to define that a projectile shock wave cannot exist unless the relative difference between projectile velocity and gaseous envelope velocity equals or exceeds the speed of sound, and this condition exists in the muzzle area of all but a few firearms. The act of simply loading ammunition to impart projectile velocities below the speed of sound will diminish report wave noise only to the degree that the relative velocity between the projectile and propellant gas velocities are below the speed of sound. These events are directly related to the claims of efficiency that our invention takes advantage to mitigate muzzle flash; suppress report noise and counter recoil force.

The second and third aspect of transition ballistics is vertical and horizontal or lateral barrel whip; studies indicate this event provides a significant psychological portion of perceived recoil by the person discharging the firearm. All gun barrels tend to bend down during rest to a degree determined by their form and rigidity factors. This condition is most prevalent in light shoulder fired firearms; but is also a factor up to cannon bore barrels. Vertical barrel whip is that action that takes place as the projectile moves rapidly through the bore; causing an upward rise of the barrel that attains its maximum the instant the projectile exits the barrel.

Concurrently; rotation of the projectile as defined by the rifling helix imparts a counter torque to the barrel and the vertical vector of this torque amplifies barrel rising whip. Horizontal or lateral barrel whip has a similar effect; but of far less magnitude than vertical whip. Lateral barrel whip is mechanical and is most often caused by poor manufacturing techniques that result in a lateral bend in the barrel and greater attention to barrel manufacturing accuracy can relegate lateral whip to insignificance in actual practice.

Susceptible recoil force is defined as that increment of total recoil force that can be mitigated by muzzle attached devices. The recoil in all projectile launching devices begins instantly upon acceleration of the projectile by the rapid expansion of propellant gas; and instantly transfers equivalent kinetic energy to the gun mechanism, mount and holding device. The most significant transfer of recoil energy is during the earliest stages of the forcefully expanding propellant gas and accompanying high pressure; accelerating the projectile from rest to near maximum velocity at the muzzle. Prior art suppression devices have consistently emphasized that their effect on recoil, flash, noise and blast is dependent on conditions at projectile exit from the bore and utilization of the escaping gas at the muzzle; a condition much later than recoil has begun. Consequently, with prior art devices, during the critical two or three milliseconds the projectile is within the bore, the only significant factor acting to suppress recoil is the mass of the gun and its mount or holding device.

The description of the various events of a firearm discharge indicates that prior art devices intended to suppress recoil, noise, blast and flash act after the exit of the projectile from the bore which is two to three milliseconds after propellant ignition. It is known that propellant generated recoil force on the firearm and projectile does not cease until the propellant gas pressure has fallen to atmospheric pressure; and tests on firearms up to light cannon caliber defines this circumstance as occurring some eight milliseconds after propellant ignition and six milliseconds after the projectile has left the bore. This six-millisecond time interval of the projectile launching event; and unlike prior art devices, the very earliest three-millisecond movement of the forward air mass in the bore in front of the projectile is the precise object our invention design utilizes to achieve greater efficiency in the mitigation of recoil, noise, blast and flash in thermodynamic jetting devices and other high pressure, high velocity heat engine exhaust mechanisms.

To clarify the design, intended object of use, manufacture methods and functional efficiency of our invention, we herein address in detail each drawing that displays high speed photographs of events that are part of the total high pressure, high velocity gaseous discharge cycle. Further, we provide detail drawings of the functional parts of our invention as well as the full and complete dimensioning parameters required to make and use our invention. Further, we provide a description of the various metal alloys we used in construction that proved suitable for use in producing our invention.

FIG. 1 displays a Schlieren high speed photograph of the emerging compressed atmospheric contents of the bore at near projectile velocity. From the first instant of this critical phase, the expansion, compression and magnetic diversion chambers of our invention begins suppression, cooling and redirecting the particle mass flow of high pressure, high velocity gasses extracting energy and mitigating the formation of the spherical primary shock wave 70. Mitigation of this shock wave is critical in reduction of muzzle flash and report noise caused by the following projectile later piercing this shock wave.

Figure 2:
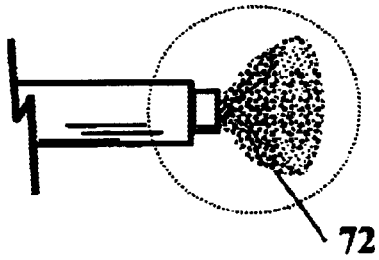
FIG. 2 displays the emerging projectile from the barrel bore, approximately 3 milliseconds after propellant ignition accompanied by small amounts of propellant gasses that have forced by the projectile body.

FIG. 2 displays the emerging projectile with small amounts of propellant gasses 72 that have forced past the projectile body. Ahead of this occurrence can be seen the still expanding primary spherical shock wave; that unless mitigated, reduced or prevented will provide the majority of the report noise when the projectile pierces this shock wave some 35 centimeters, about 14 inches, in front of the muzzle.

Figure 3:
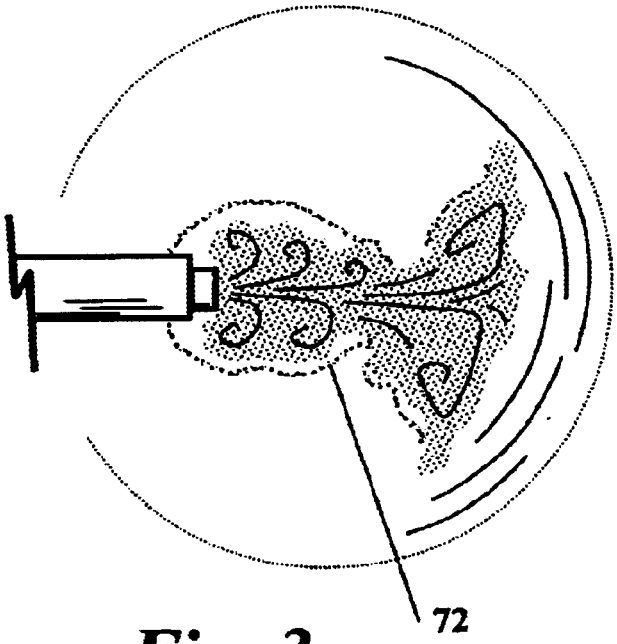
FIG. 3 displays the emerging propellant gasses directly after projectile exit from bore and includes unburned propellant and hydrogen gas.

FIG. 3 displays the emerging propellant gasses 74 following the projectile; and due to great residual pressure, rush past the projectile imparting the force which accelerates the projectile to its maximum velocity some 35 centimeters, about 14 inches, ahead of the muzzle. At this stage, about 8 milliseconds after propellant ignition, the projectile; accompanied by it's shock wave, will overtake and pierce the primary spherical shock wave; generating the report noise of the exploding propellant. This event cannot occur unless the relative difference in velocity between the projectile and primary gaseous envelope equals or exceeds the speed of sound.

Figure 4:
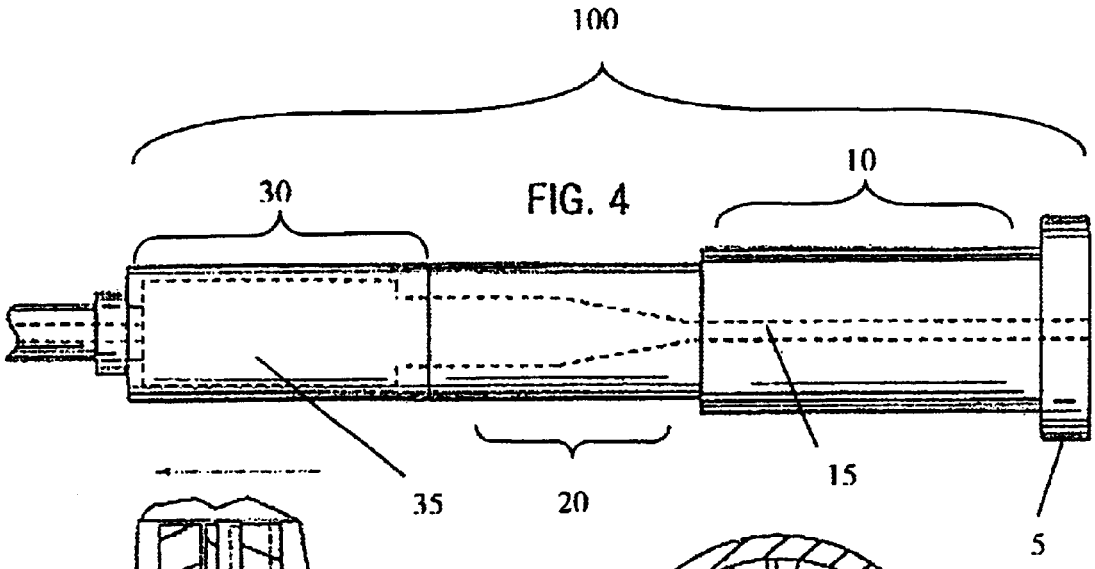
FIG. 4 displays the full assembly of the attachment as affixed to barrel muzzle and depicts a phantom view of the barrel, the primary chaotic expansion chamber followed by the secondary convergent compression chamber and lastly, the magnetic toroid diversion chamber coaxially secured and retained by wave washers and the threaded compression flange.

FIG. 4 displays a phantom view of the fully assembled embodiment 100 of our invention. It is shown as typically attached to the muzzle 50 of a firearm barrel as the primary chaotic expansion chamber 30, the secondary convergent compression chamber 20; and lastly, the magnetic diversion chamber assembly 10 with it's threaded flange retaining cap.

FIG. 5A displays the sectionalized view of the primary chaotic expansion chamber 30; threaded at 40 for use and typically affixed to the muzzle 50 of a firearm barrel. The object of this chamber 30 is to provide an area whose gross volume capacity has been determined to be at least twelve times greater than the volume capacity of the full volume of the bore of the firearm it is attached to. This ratio of volume capacity provides the most efficient chaotic expansion of the high pressure, high velocity propellant gasses. In this chamber, the primary initial shock wave; consisting of the bore atmospheric air contents ahead of the projectile, enters the chamber at supersonic velocity. Upon entering the expansion chamber; the supersonic gasses increase velocity due to their existing compression that generates a partial conversion of the potential energy in the compressed gas to kinetic energy; resulting in a decrease in the pressure of the gas column. This critical action expends and dissipates a significant portion of the energy in the primary shock wave; and is in agreement with the Bernoulli theorem of supersonic gas flow.

Experimental testing indicates that high strength; non-magnetic, metallic alloy such as 7075T6 aluminum alloy or 303 series stainless steel provides ample strength and superior corrosion resistance to assure long term performance in this application.

FIG. 5B displays the secondary convergent compression chamber 20 with threaded tenons 22 which affix it into an intermediate position in the assembled attachment. This chamber is configured so as to present a gross volume capacity no greater than three times the volume capacity of the firearm bore. The object of this chamber is to recompress the supersonic, high pressure gaseous column that enters it from the primary chaotic expansion chamber; FIG. 5A.

The supersonic, high pressure gas column that enters the secondary convergent compression chamber 20 is instantly compressed by the smaller volume and tapered cone 25 of this chamber forcing the high pressure gas flow into an exit hole 35 percent larger than the bore diameter of the barrel. This action results in a gas column that will be recompressed; thereby raising it's pressure and; upon exit from the secondary chamber, the gas velocity cannot exceed the speed of sound; regardless of the magnitude of the pressure then existing within the convergent diversion chamber.

The pre-conditioning of the high pressure, high velocity gas flow by the primary chaotic expansion chamber 30; FIG. 5A, and the secondary convergent compression chamber 20; FIG. 5B, is critical to the overall efficiency of our invention and to the performance of the final stage of our invention; the magnetic diversion chamber 10, FIG. 5C.

FIG. 5C displays a sectionalized view of the magnetic diversion chamber 10 that is the final stage of our invention; and acts to exert a high intensity, permanent magnetic flux field that is coaxially arranged and retained by magnetic toroids 16 to enclose the final exit passage of our invention. This chamber utilizes the effects of high intensity magnetic fields; and the concurrent advantage of the Lorenz force that is inherent in the magnetic field to so modify the environment of the chambers as to mitigate, cool, helically redirect and delay a high pressure, high velocity gas column flowing through the central hole 15 of the toroidal shaped magnetic rings.

FIG. 5C, the magnetic diversion chamber 10 is constructed as a tubular sleeve manufactured of non-magnetic stainless steel such as the 303 alloy or; of high strength aluminum such as the 7075T6 alloy. Within the tubular sleeve; fitted coaxially and sequentially, is the magnetic stack comprised of toroidal rare earth magnets of neodymium-iron-boron (NIB) with a centrally located hole in the ring center that is no greater than 25 percent larger than the diameter of the projectile which will pass through the magnetic ring.

Further, spaced between each rare earth magnetic toroid 16 are located non-magnetic stainless steel wave washers 18 of a compressed in-service thickness to maintain a compressed spacing between each magnetic toroid not less than 35 percent of the bore diameter of the barrel bore. FIG. 5C depicts the magnetic stack as assembled; and clearly indicates the manner in which the flanged and threaded compression boss aligns and retains the assembly coaxially within the bore of the magnetic diversion chamber. The flange on the exterior exit face of the compression assembly reduces the possibility of reformation of the spherical shock wave.

Empirical jesting showed that a stack of sixteen rare earth magnets 16 approximately one quarter inch thick and four inches in diameter yielded a total magnetic coercive force within the magnetic diversion chamber of approximately 180,000 gauss or 18 tesla. These magnetic rings are sequentially spaced, compressed, aligned and retained coaxially by non-magnetic stainless steel wave washers 18 to assure a compressive force on the stack assembly of not less than forty pounds and not more than sixty pounds fully assembled for use.

Figure 6:
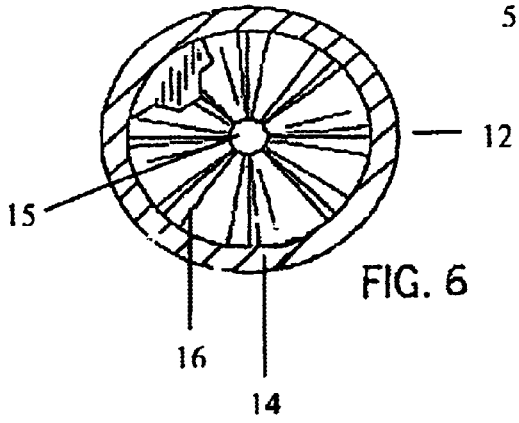
FIG. 6 displays a concentric view from the muzzle through the central bore and illustrates the concept and manner in which the magnetic toroids and wave washers are aligned around the central exhaust bore.

FIG. 6 displays a view through the central axis of the bore of the magnetic diversion chamber and illustrates the concept and manner of concentric and coaxial alignment of the magnetic toroid 16 and wave washer 18 stack around the central exhaust bore.

Figure 7:
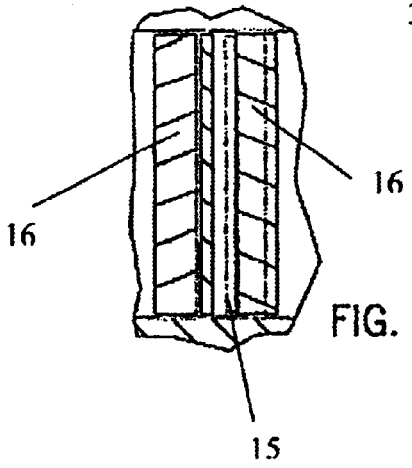
FIG. 7 displays a sectionalized view of the magnetic diversion chamber and concept of the stacking, aligning and retaining of the magnetic toroids separated and cushioned by the wave washers to be compressed by the threaded muzzle flange at final assembly.

FIG. 7 displays a lateral sectionalized view of the magnetic diversion chamber assembly method and concept showing the stacking and aligning of the magnetic toroids 16; separated and cushioned by the spacing wave washers 18 to be compressed by the threaded muzzle flange bushing 5 upon final assembly.

We claim that our invention will, with appropriate design application, mitigate, modify and cool the exit column of jet engine exhaust gasses thereby providing a reduction of the density of hot, humid condensation products emitted from jet engine exhaust; that directly cause the production of after-effect patterns known as contrails.

We further claim our invention will mitigate, modify and reduce noise and blast damage during the planned or unplanned actuation of high pressure steam safety relief valves, blowdown and letdown valves that may instigate collateral equipment damage such as displacement of valve baffles, mechanism or piping system supports.

We further claim that our invention will provide greater efficiency in the mitigation, reduction and suppression of; noise, recoil and primary and secondary muzzle blast of propellant actuated firearms; reduce the flame temperature of the exhaust gas column to less than 500 degrees centigrade; thereby mitigating the infrared signature of the firearm and canceling the effectiveness of infrared detection systems utilized to locate snipers in the performance of legitimate law enforcement duties, counterinsurgency defense and military clandestine mission activity.

We further claim our invention exceeds the efficiency of prior art devices; by the novel application of magnetic helical gas column particle diversion, in the mitigation and suppression of noise, recoil and blast of high pressure exhaust devices, reducing and mitigating the effect of the high specific impulse of hydrogen gas in the propellant exhaust cloud due to the very low molecular weight of hydrogen; thereby further increasing the efficiency of our invention in blast and flash suppression.

We claim:

1. A device for the suppression of high velocity gases, comprising:

a plurality of tubular chambers, attached longitudinally end-to-end, comprising a continuous pathway permitting the passage of gases from one entrance end to the other exit end;

at least one said chamber having a conical shaped interior space, possessing a large interior diameter at the chamber end closer to said entrance end, and a smaller interior diameter at the opposite end, closer to said exit end, thus forcing a gas flowing in one direction through said chambers to become compressed; and, at least one said chamber housing an array of high magnetic intensity rare earth magnetic toroids, disposed such that gases can permeate said array when flowing in one direction through said chambers.

2. The device of claim 1, further comprising attachment means at said entrance end of said tubular chambers, for the attachment of said device to the muzzle of a gun.

3. The device of claim 1, wherein said rare earth magnetic toroids are comprised of combinations of elements selected from the group consisting of iron, samarium, neodymium, cobalt, boron, and carbon.

4. The device of claim 1, wherein said magnetic toroids are arranged an radial fashion around the central bore of the chamber.

5. The device of claim 1, wherein said tubular chambers are comprised of high strength, non-magnetic, metallic alloy.

6. The device of claim 1, further comprising a final rigid exit passage for gases and projectiles.

7. The device of claim 1, wherein said tubular chambers are comprised of metal selected from the group consisting of 7075T6 aluminum alloy and 303 series stainless steel.

8. The device of claim 1, wherein said magnetic toroids are between ⅛ and ½ inch thick, and between 2 and 6 inches in diameter.

9. The device of claim 1, wherein said magnetic toroids are separated from adjacent toroids by a plurality of washers.

10. The device of claim 1, wherein said washers are comprised of high strength, non-magnetic, metallic alloy.

11. The device of claim 1, wherein said washers are sufficient in number and strength to assure a compressive force on the stack assembly of between forty and sixty pounds when fully assembled.

12. The device of claim 1, wherein said tubular chambers are removably attached by means of mating threaded screw attachments at the mating ends of each pair of said chambers.

13. The device of claim 1, wherein magnetic field intensities of between 1 and 3 tesla are attained.

14. The use of the device of claim 1 to lessen and mitigate recoil, noise, blast and flash in a thermodynamic jetting device by following the steps of:

a. attaching the device of claim 1 to the exit port of said jetting device; and, b. operating said jetting device while the device of claim 1 remains attached thereto.

15. The use of the device or claim 1 to lessen and mitigate recoil, noise, blast and flash in high pressure, high velocity heat engine exhaust by following the steps of:

a. attaching the device of claim 1 to the exhaust pipe of an engine; and, b. operating said engine while the device of claim 1 remains attached thereto.

16. The use of the device of claim 1 to lessen and mitigate recoil, noise, blast and flash in a firearm by following the steps of:

a. attaching the device of claim 1 to the muzzle of said firearm; and, b. operating said firearm while the device of claim 1 remains attached thereto.

17. A device for the suppression of high velocity gases, comprising:

a cylindrical, substantially hollow tube, comprised of sectional chambers, arranged longitudinally end-to-end, comprising a continuous pathway permitting the passage of gases from one entrance end to the other exit end;

at least one said chamber having a conical shaped interior space, possessing a large interior diameter at the chamber end closer to said entrance end, and a smaller interior diameter at the opposite end, closer to said exit end, thus forcing a gas flowing in one direction through said chambers to become compressed; and, at least one said chamber housing an array of high magnetic intensity rare earth magnetic toroids, separated by washers, and disposed in a radial array around said continuous pathway such that gases permeate said array when flowing in one direction through said chambers.

18. The use of the device of claim 17 to lessen and mitigate recoil, noise, blast and flash in a thermodynamic jetting device by following the steps of:

a. attaching the device of claim 17 to the exit port of said jetting device; and, b. operating said jetting device while the device claim 17 remains attached thereto.

19. The use of the device of claim 17 to lessen and mitigate recoil, noise, blast and flash in high pressure, high velocity heat engine exhaust by following the steps of:

a. attaching the device of claim 17 to the exhaust pipe of an engine; and, b. operating said engine while the device of claim 17 remains attached thereto.

20. The use of the device of claim 17 to lessen and mitigate recoil, noise, blast and flash in a firearm by following the steps of:

a. attaching the device of claim 17 to the muzzle of said firearm; and, b. operating said firearm while the device of claim 17 remains attached thereto.

* * * * *